US010766748B2

(12) United States Patent
Tranchero

(10) Patent No.: US 10,766,748 B2
(45) Date of Patent: Sep. 8, 2020

(54) CRANE FOR LIFTING AND TRANSPORTING LOADS COMPRISING A ROLL-OVER PROTECTION SYSTEM

(71) Applicant: Jacques Tranchero, Costigliole Saluzzo (IT)

(72) Inventor: Jacques Tranchero, Costigliole Saluzzo (IT)

( * ) Notice: Subject to any disclaimer, the term of this patent is extended or adjusted under 35 U.S.C. 154(b) by 484 days.

(21) Appl. No.: 15/510,664

(22) PCT Filed: Sep. 7, 2015

(86) PCT No.: PCT/IB2015/056823

§ 371 (c)(1),
(2) Date: Mar. 10, 2017

(87) PCT Pub. No.: WO2016/038525

PCT Pub. Date: Mar. 17, 2016

(65) Prior Publication Data

US 2017/0217740 A1 Aug. 3, 2017

(30) Foreign Application Priority Data

Sep. 11, 2014 (IT) ..... TO14A0711

(51) Int. Cl.
*B66C 23/48* (2006.01)
*B66C 23/90* (2006.01)

(52) U.S. Cl.
CPC ..... *B66C 23/48* (2013.01); *B66C 23/90* (2013.01); *B66C 23/905* (2013.01)

(58) Field of Classification Search
CPC ..... B66C 23/48; B66C 23/90; B66C 23/905
See application file for complete search history.

(56) References Cited

U.S. PATENT DOCUMENTS 4,216,868 A * 8/1980 Geppert ..... B66C 23/905 212/278
5,645,181 A * 7/1997 Ichiba ..... B66C 13/46 212/281

(Continued)

FOREIGN PATENT DOCUMENTS

DE 202014001886 U1 4/2014
EP 0860395 A2 8/1998
FR 2481686 A1 11/1981

OTHER PUBLICATIONS

International Search Report and Written Opinion from corresponding International Patent Application No. PCT/IB2015/056823, dated Dec. 15, 2016, 8 pages.

*Primary Examiner* — Saul Rodriguez
*Assistant Examiner* — Ashley K Romano
(74) *Attorney, Agent, or Firm* — Merchant & Gould P.C.

(57) ABSTRACT

A crane for lifting and transporting loads includes a base frame, capable of transferring the loads onto a support surface. A sliding element is slidably constrained to the base frame. An arm capable of moving the loads is hinged to the sliding element. A connection element has a first end hinged to the sliding element, and a second end constrained to the base frame in a mobile manner. Each of a pair of rod elements is hinged to the base frame and to the connection element to form an articulated quadrilateral. A first linear actuator is hinged to the base frame and to the connection element and capable of causing sliding movement of the sliding element relative to the base frame. A second linear actuator is hinged to the sliding element and to the arm capable of causing mutual rotation movement between the arm and the sliding element.

12 Claims, 5 Drawing Sheets

(56) References Cited

U.S. PATENT DOCUMENTS

| | | | | |
|---|---|---|---|---|
| 2013/0066527 | A1* | 3/2013 | Mizuochi | B66C 23/905 701/50 |
| 2013/0345938 | A1* | 12/2013 | Ruoss | B66C 23/905 701/50 |
| 2014/0116975 | A1* | 5/2014 | Benton | B66C 23/88 212/302 |

* cited by examiner

CRANE FOR LIFTING AND TRANSPORTING LOADS COMPRISING A ROLL-OVER PROTECTION SYSTEM

This application is a National Stage Application of International Patent Application No. PCT/IB2015/056823, filed 7 Sep. 2015, which claims benefit of Serial No. TO2014A000711, filed 11 Sep. 2014 in Italy and which applications are incorporated herein by reference. To the extent appropriate, a claim of priority is made to each of the above disclosed applications.

TECHNICAL FIELD

The present invention relates to a crane, or equipment, for lifting and moving loads, equipped with an implemented roll-over protection system.

TECHNOLOGICAL BACKGROUND

In the industrial field, as well as in the craft industry, the need to pick up, move and position loads, even considerably heavy ones, to/at substantial heights and distances from the pick-up point is well known.

However, due to the considerable weight of the load to be moved, as well as the distance between said load and the crane, the crane is in danger of rolling over, consequently posing risks to the people in its vicinity and to the goods. Furthermore, during the moving of loads, there is a high risk of dynamic roll-over due to the abrupt movements of certain parts of the crane itself.

Therefore, the need is felt to provide cranes for lifting and moving loads, which are equipped with an implemented roll-over protection system and are able to intervene in a prompt, precise and safe manner.

SUMMARY OF THE INVENTION

An object of the present invention is to provide a crane for lifting and moving loads, equipped with a roll-over protection system, which is able to solve this and other drawbacks of the prior art and which, at the same time, can be produced in a simple and economic fashion.

In particular, one of the technical problems solved by the present invention is that of providing a crane for lifting and moving loads, equipped with an implemented roll-over protection system, which is able to intervene in a prompt, precise and safe manner.

One particular variant of the invention has the object of providing a crane for lifting and moving loads, capable of performing a wide range of movements.

The appended claims are an integral part of the technical teaches provided in the following detailed description concerning the present invention. In particular, the appended dependent claims define some preferred embodiments of the present invention and describe optional technical features.

BRIEF DESCRIPTION OF THE DRAWINGS

Further features and advantages of the present invention will be best understood upon perusal of the following detailed description, which is provided by way of example and is not limiting, with reference, in particular, to the accompanying drawings, wherein.

DETAILED DESCRIPTION OF THE INVENTION

Figure 1:
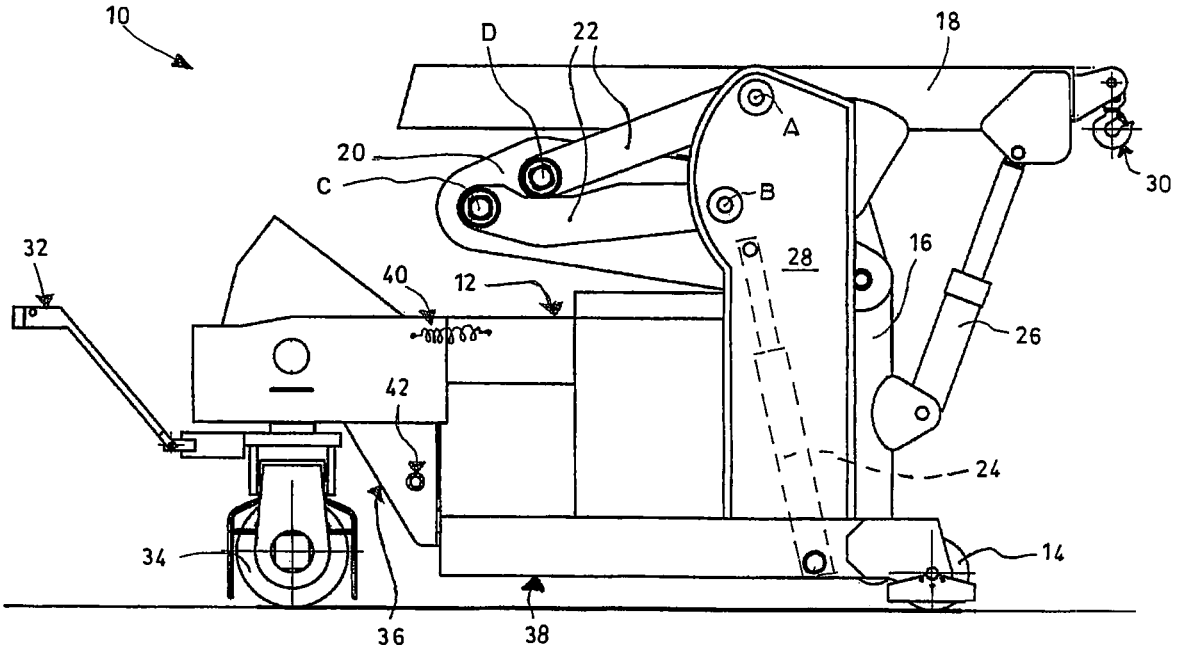
FIG. 1 is a lateral view of a crane according to an embodiment of the present invention.

With reference to the accompanying figures, number 10 indicates, as a whole, a crane for lifting and moving loads, comprising:

a base frame 12, capable of transferring the loads of crane 10 onto a support surface by means of contact means arranged in contact with said surface, such as wheels 14;

a lifting mechanism to lift and transport loads, associated with said base frame (12);

Crane 10 is also equipped with a roll-over protection system comprising:

a first portion (36) and a second portion (38) of base frame (12), mutually hinged to one another, the first (36) and the second portion (38) being also constrained by at least one elastic means (40); and a control system adapted for detecting the mutual position between the first (36) and the second portion (38) and of carrying out predetermined tasks of crane (10) when said mutual position reaches a threshold condition.

For greater clarity, a non-limiting description of a crane 10 having a particular structure and a preferred lifting mechanism is provided below.

With particular reference to the variant shown in figures from 1 to 6, crane 10 comprises:

base frame 12;

a sliding element 16 which is constrained to base frame 12 in a sliding manner;

an arm 18, adapted for moving the loads and is hinged to the sliding element 16;

a connection element 20 having a first end, which is hinged to sliding element 16, and a second end, which is constrained to base frame 12 in a mobile manner;

a pair of rod elements 22, each rod element 22 being hinged to said base frame 12 and to said connection element 20 so as to form an articulated quadrilateral;

a first linear actuator 24, hinged to base frame 12 and to connection element 20 and s able to cause the sliding movement of sliding element 16 relative to base frame 12;

a second linear actuator 26, hinged to sliding element 16 and to arm 18 and is able to cause the mutual rotation movement between arm 18 and sliding element 16.

In a non-limiting manner, FIG. 1 shows an articulated quadrilateral, which is defined by the points indicated with letters A, B, C, D.

In the preferred variant shown in FIG. 1, sliding element 16 is adapted to slide substantially vertically.

In particular, base frame 12 comprises a pair of uprights 28, which are provided with guides, on which the sliding element 16 is designed to slide.

In the example, arm 18 and sliding element 16 are longitudinal elements; conveniently, they are beam elements, preferably internally hollow.

Sliding element 16 is arranged along a substantially vertical line and, in correspondence to its upper end, it is hinged to arm 18. Therefore, arm 18 and sliding element 16 are suited to mutually rotate. In the preferred example shown, sliding element 16 is able to perform a vertical sliding motion relative to base frame 12, and arm 18 is able to rotate relative to said sliding element 16. Consequently, arm 18 is able to perform a rotational-translational motion, thus allowing crane 10 to have ample freedom of movement.

With particular reference to the constraint between sliding element 16 and arm 18, the term "hinged" should not be understood in a limiting way: i.e. sliding element 16 and arm 18 can be connected by means of a through pin, but, alternatively, they can also be constrained by means of any hinge system suited to allow them to mutually rotate. A similar observation applies to the other hinge constraints to be found in crane 10.

Conveniently, arm 18 is telescopic.

With reference to a particular variant that is not shown herein, arm 18 is telescopic and comprises three mutually sliding segments, which are controlled by a third linear actuator. The first segment is constrained to the sliding element in a rotary manner, the second segment can slide relative to the first segment, and the third segment can slide relative to the second segment. The third linear actuator is adapted to perform the extraction/retraction of the segments, so as to increase/decrease the reach of arm 18. In this way, loads can also be moved to considerable distances from the point where crane 10 is located, while ensuring a high degree of compactness of crane 10 itself.

Conveniently, hydraulic actuators 24, 26, or at least one of them, are hydraulic jacks mainly consisting of a piston sliding inside a cylinder.

Preferably, arm 18 is provided with means for attaching and transporting the loads, such as, for example, a clamp, tongs, a hook 30, or a platform, etc.

For example, arm 18 is associated with a winch system or a hoist, in order to move the loads. Said winch is conveniently activated by a motor means, such as an electric motor.

The winch (or hoist) is associated with a hook 30, or the like, which can be extracted or retracted by operating the winch.

According to a variant which is not shown herein, arm 18 comprises a pair of hooks: the first hook is controlled by a winch and is therefore mobile, or extractable, relative to arm 18; the second hook, on the other hand, is fixed with respect to arm 18. In particular, the first and the second hook can be placed on the distal end of the telescopic segment of arm 18.

According to further variants, arm 18 can only be associated with one or more fixed hooks. Furthermore, the point in which the hooks, either fixed or extractable, are associated with arm 18 in the following examples should not be understood in a limiting way. For example, it is possible that the fixed hook is attached to the first or the second segment and is therefore not to be found on the distal end of arm 18. Furthermore, it is possible to associate the at least one hook with a non-telescopic arm 18 as well.

With a non-limiting reference to the variant shown in FIG. 1, connection element 20 is manufactured by means of a pair of plates, among which an end of the first linear actuator 24 is hinged (in particular the upper end), and each plate is associated with a respective pair of rod elements 22 so as to create an articulated quadrilateral with the respective plate 20 and base frame 12.

In particular, base frame 12 comprises a pair of uprights 28, and each upright 28 is connected in a mobile manner to the respective plate 20 by means of the respective pair of rod elements 22. Therefore, in the example shown, there are two uprights 28 belonging to base frame 12, two plates making up the connection element 20, and four rod elements 22.

This preferred embodiment allows some of the mobile elements suited to lift and move the load to partially interlock with each other, thus combining a high load capacity and a wide range of movements in a remarkably compact structure.

The lower end of the first linear actuator 24 is hinged to the lower part of base frame 12 and said first linear actuator 24 is mainly located between the two uprights 28. The first linear actuator 24 is also located between the two pairs of rod elements 22 and between the two plates making up connection element 20. In this configuration, which represents a preferred non-limiting variant of the invention, crane 10 gains remarkable compactness.

Generally, the two plates making up connection element 20 are mutually constrained by means of structural elements such as connection brackets or the like. Conveniently, a tubular element or a pin is fixed between the plates, the upper end of the first linear actuator 24 being pivoted on said tubular element or pin.

In the variant shown herein, the two plates 20 are arranged laterally with respect to sliding element 16, close to the point where they are hinged to said sliding element 16.

Figure 2:
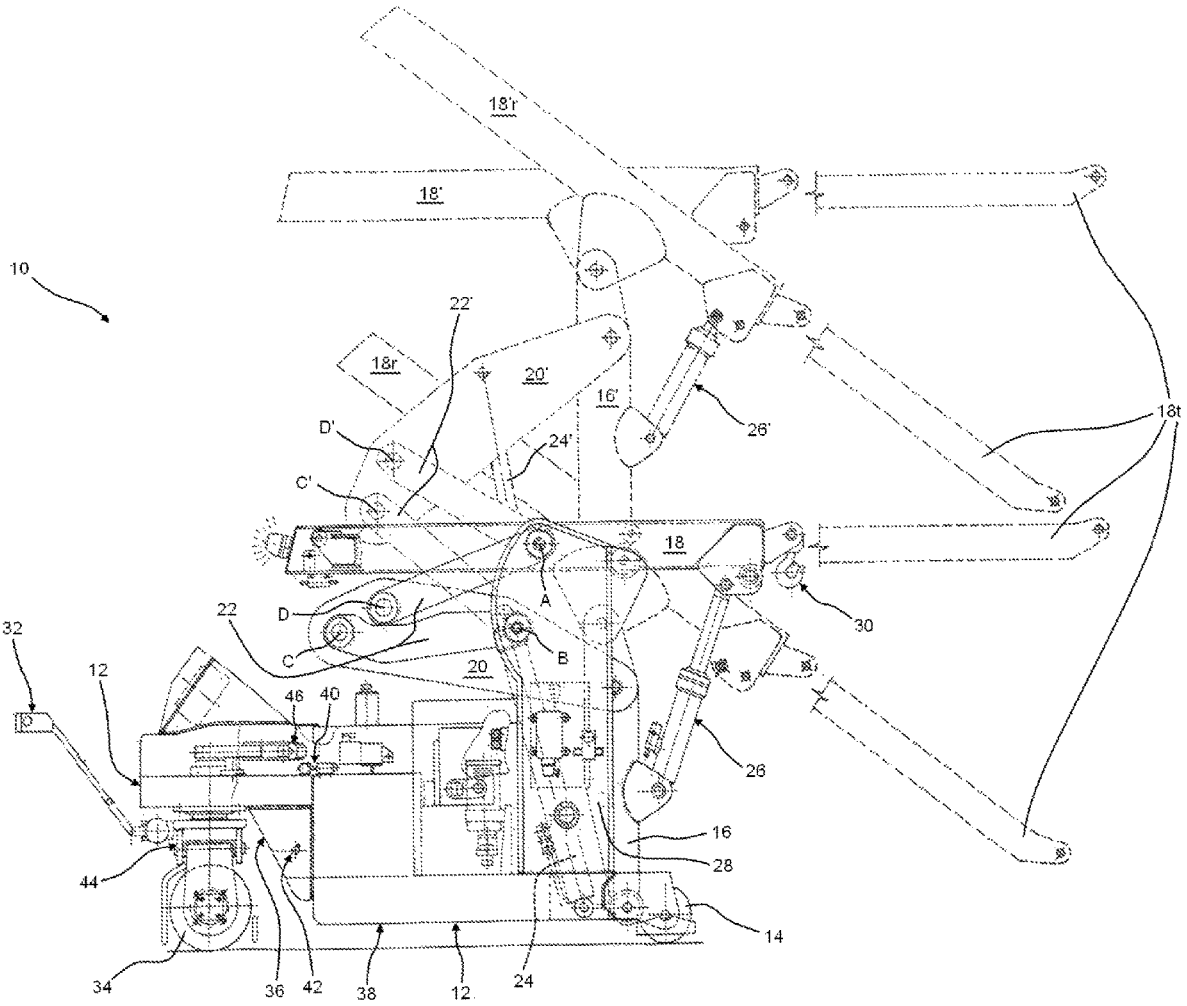
FIG. 2 is a lateral view of a crane according to the invention, shown in different operating conditions.

FIG. 2 shows a variant of crane 10 in four different operating conditions.

In the first operating condition, arm 18 is in a lowered position and is arranged horizontally, and one can see other mobile elements, among which rod elements 22, connection element 20, sliding element 16 and linear actuators 24, 26.

In the second operating condition, arm 18*r* is in a lowered and inclined position.

In the third operating condition, arm 18' is in a lifted position and is arranged horizontally, and one can see other mobile elements, among which rod elements 22', connection element 20', sliding element 16' and linear actuators 24', 26'. In this lifted condition, C' and D' indicate the points that, together with A and B, make up the articulated quadrilateral. Indeed, points A and B are fixed with respect to base frame 12 (in particular A and B belong to uprights 28), while points C, C' and D, D' are mobile and represent the point where rod element 22 is hinged to connection element 20.

In the fourth operating condition, arm 18'*r* is in a lifted and inclined position.

As already mentioned above, in order to move arm 18 from lowered condition (18, 18*r*) to the lifted one (18', 18'*r*) and vice versa, the first linear actuator 24 is used; whereas in order to allow arm 18 to tilt, the second linear actuator 26 is used.

In the figure, 18*t* schematically indicates the telescopic segment of arm 18.

Figure 6:
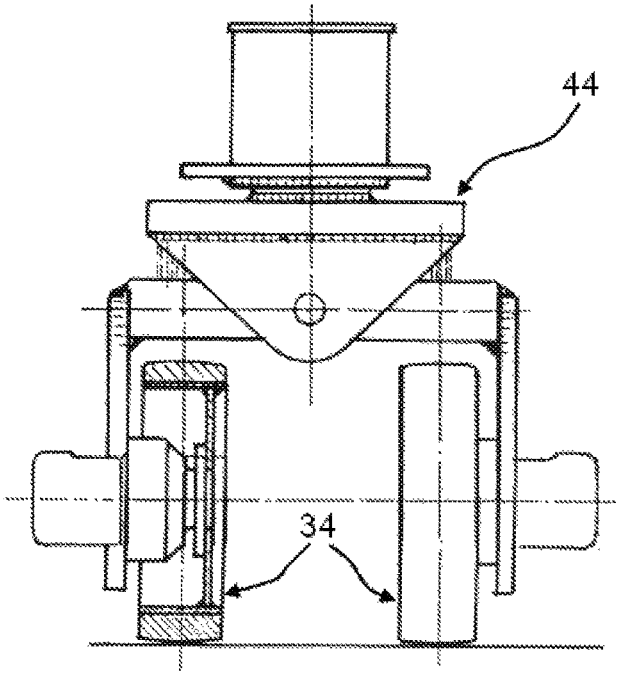
FIG. 6 is a front view of a further detail of the crane.

Preferably, crane 10 comprises a ground drive transmission means to transmit the drive to the ground, which is controlled by a rudder 32, conveniently a servo-assisted one. The ground drive transmission means can comprise a driving wheel 34, or a track, or any other means suited to transmit a driving force onto a support surface. For example, FIG. 6 shows a preferred ground drive transmission means comprising a pair of driving wheels 34, which are conveniently able to rotate independently of one another. This solution turns out to be particularly advantageous when steering, since the presence of a pair of wheels 34, compared to a single wheel, brings about a reduction in the friction force arising between wheels 34 and the ground and obstructing the steering.

The pair of wheels 34 is supported by a support structure 44 associated with base frame 12 in a rotary manner, in particular it is associated with the first portion 36. For the sake of simplicity, in the remaining part of the description, reference is made to driving wheel 34, nonetheless without limiting the inventive concept.

Figure 3:
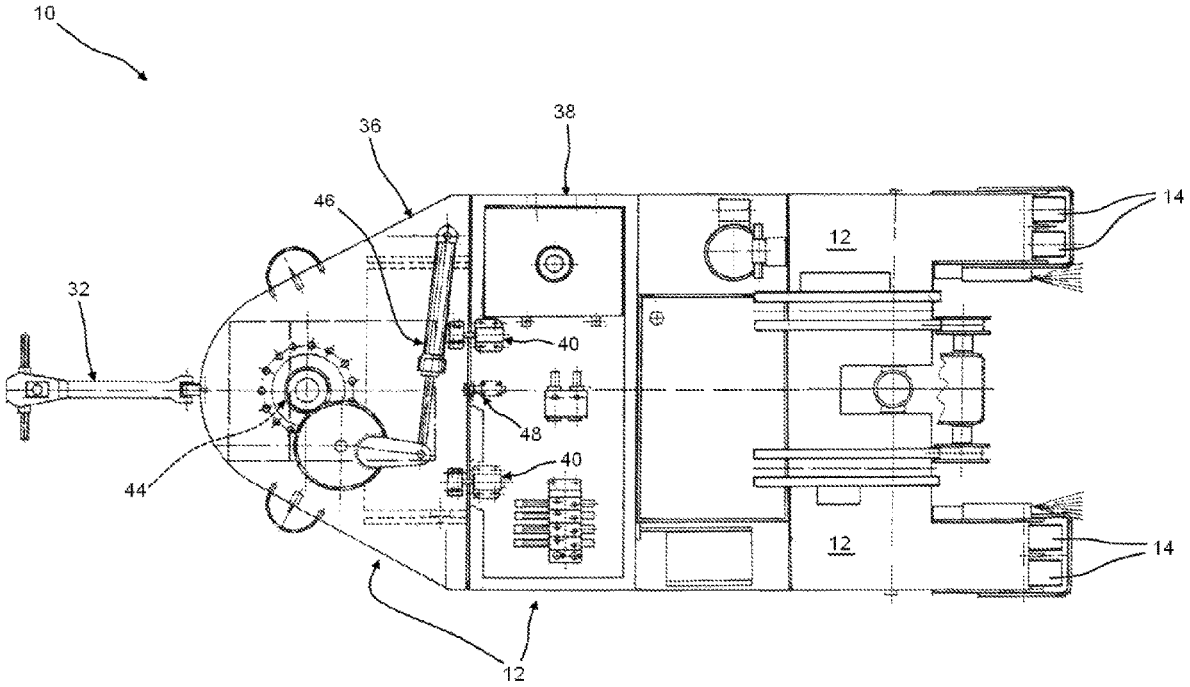
FIG. 3 is a plan view of a crane according to the invention.
Figure 4:
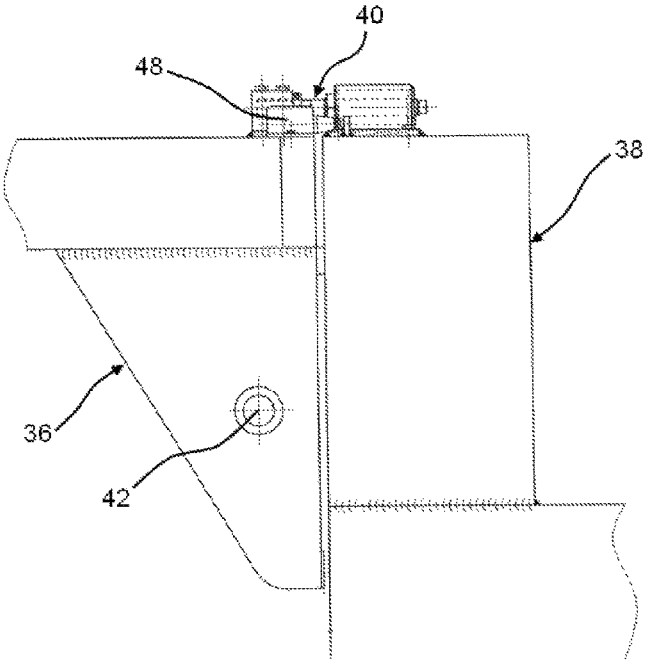
FIG. 4 is a lateral view of a detail of the crane.
Figure 5:
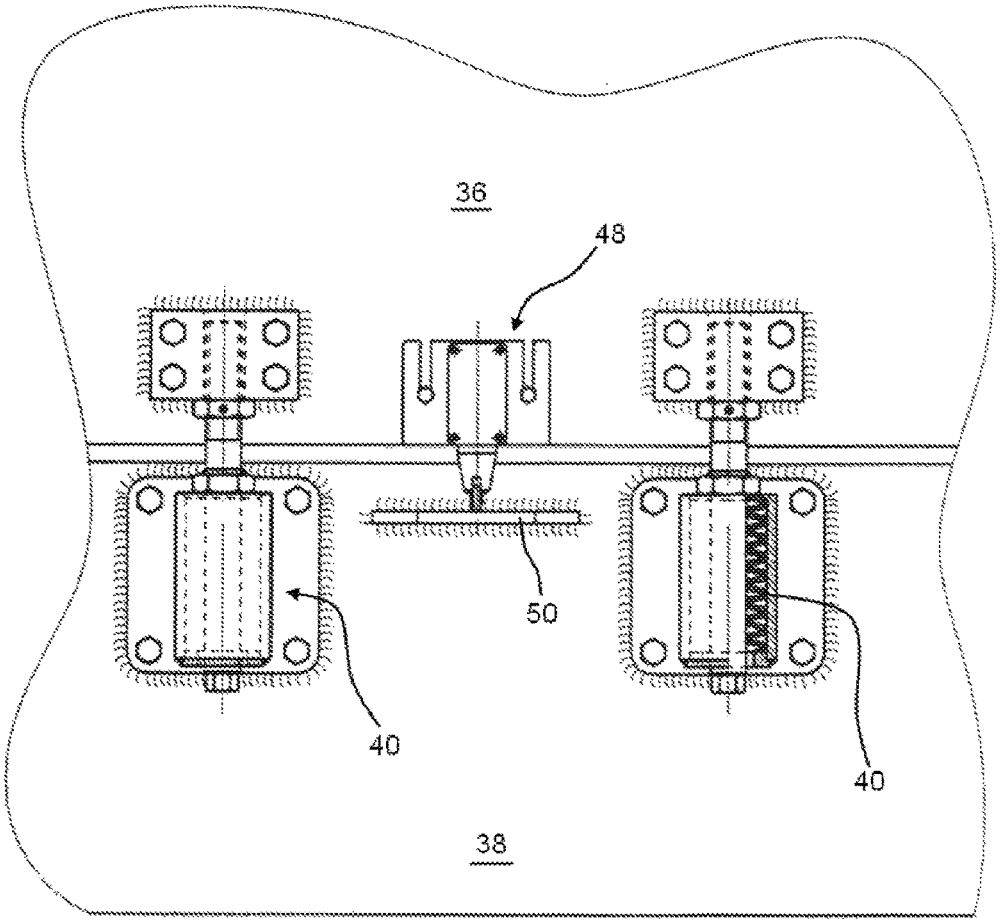
FIG. 5 is a plan view of a further detail of the crane.

The servo-assistance of the steering gear can be of a known type, and it is useful to reduce the force that needs to be exerted by a user who intends to steer the wheel manually by holding the rudder, thus making the crane easier to use, especially when the weight of the crane and of the supported load amounts to a few tons, in which case the friction force of the wheel on the ground would make it difficult for a user to steer only manually. In the example shown in FIGS. 3 and 6, on the first portion 36 there is a steering linear actuator 46, for example a hydraulic jack, which acts upon support structure 44, allowing it to rotate relative to base frame 12. Steering linear actuator acts upon support structure 44 by means of a gear 52 which is associated with base frame 12. Alternatively, steering linear actuator 46 can be directly constrained (in particular by means of a hinge) to support structure 44; or it can be connected to support structure 44 by means of further mechanisms.

Preferably, rudder 32 is equipped with a plurality of control tools to control the movement of crane 10 and the movements of the "lifting mechanism" comprising arm 18, sliding element 16, rod elements 22, connection element 20. By using the control tools it is possible to control the activation of linear actuators 24, 26, and, if necessary, of the third linear actuator. By using the control tools it is also possible, if necessary, to control the activation of the means for attaching and transporting the loads, such as extractable hook 30, etc.

The control tools can comprise, for example, push-buttons, levers, screens, warning lights, sirens, indicators of different types, thus allowing the user to receive signals of various kinds regarding the operation of crane 10.

According to a preferred embodiment of the present invention, crane 10 comprises a wireless remote control system, adapted for controlling the movement of arm 18 and/or the movement of ground drive transmission means 34. In the further advantageous variant in which the remote control system is suited to control both the movement of arm 18 and the movement of driving wheel 34, the operator can operate in a totally remote manner by remaining at a distance from crane 10 during the movement of the crane itself on the supporting ground, as well as during the moving of the loads. By so doing a higher degree of safety is achieved, due to the fact that the user does not have to remain in contact with crane 10 while performing all the operations anymore, in particular when it is necessary to operate in dangerous situations, such as unsafe environments where there may be falling objects, the presence of high temperature objects, the presence of harmful substances, etc.

The roll-over protection system will now be described in detail, with a non-limiting reference to the examples shown and explained herein.

As already mentioned above, the control system is capable of detecting the mutual position between the first 36 and the second portion 38 and of carrying out predetermined tasks of the crane when said mutual position reaches a threshold condition.

For example, arm 18 of crane 10 is telescopic and, when the mutual position reaches the threshold condition, the control system prevents telescopic arm 18 from extending or moving.

With particular reference to figures from 3 to 5, the roll-over protection system comprises a pair of elastic means (in the example, springs) 40, each connected to the first 36 and to the second portion 38 of base frame 12.

Preferably, crane 10 comprises at least one sensor (a sensor means, or the like) capable of detecting the mutual position between said portions 36, 38. The at least one sensor is conveniently associated with the first 36 and/or the second portion 38 of the base frame.

With reference to the variant shown, a sensor 48 is advantageously used, which is associated with one of said portions (in the example, said sensor is associated with the first portion 36) adapted to detect the proximity to or the contact with the other portion (in particular, the second portion 38). Sensor 48 is preferably a contact sensor or a proximity sensor (e.g. a photodetector, a sensor of the capacitive, inductive, magnetic, ultrasound or optical type, etc.).

On the second portion 38 there is a striker portion 50 adapted to cooperate with sensor 48, so as to signal the mutual position between the first 36 and the second portion 38. Alternatively, crane 10 can be provided with further known types of sensors, to be arranged on the first 36 and/or second portion 38 of base frame 12, designed to detect the mutual position between said portions.

According to a particular variant, the detection of the mutual position between the first 36 and the second portion 38 is carried out by means of the detection of the deformation of elastic means 40. Indeed, since the first 36 and the second portion 38 are constrained by means of at least one hinge (in the figure, number 42 indicates, by way of example, the hinging point, which from now on will also be called "hinge" for the sake of brevity) and at least one elastic means 40, the deformation of elastic means 40 is linked to the position of the first 36 and second portion 38, which are capable of rotating around the hinging point 42. With a non-limiting reference to figures from 1 to 4, hinge 42 is located in the lower part of base frame 12 and elastic means 40 is located in an upper part; therefore, the two portions 36, 38 of base frame 12 are constrained to rotate around hinging point 42, and said rotation corresponds to a greater or smaller elongation of elastic means 40. Therefore, by measuring the deformation of elastic means 40, it is possible to detect the mutual position between the first 36 and the second portion 38.

In general, when the mutual position between the first 36 and the second portion 38 reaches a threshold condition, or a threshold value, the control system can be suited to carry out many and different predetermined tasks, such as for example: stopping one or more linear actuators 24, 26, 46; performing one or more predetermined movements of at least one linear actuator 24, 26, 46; interrupting the operation of driving wheel 34; emitting an emergency signal that can be perceived by a user (e.g. light and/or sound signal), etc.

In general, the control system can be designed in such a way that, when the mutual position between the first 36 and the second portion 38 reaches a threshold value, every movement of crane 10 that is likely to cause an increase in the rolling-over torque is interrupted or inhibited. The control system can also be designed in such a way that, when the mutual position between the first 36 and the second portion 38 reaches a threshold value, one or more movements of crane 10 that are likely to cause a decrease in the rolling-over torque are carried out.

By mere way of example, a description follows of how the roll-over protection system operates with reference to the variant of crane 10 shown. During the load moving operations, telescopic arm 18 supports a load at its ends; depending on the extension of said arm 18, a rolling-over torque is generated relative to the support base of crane 10—in the example shown, the support base is made up of the support wheels 14 and driving wheel 34. Therefore, when the extension of arm 18 generates a rolling-over torque having a limit value, the crane is in danger of rolling over, consequently posing risks to the health of the people in its vicinity, to the integrity of the goods and of the surrounding environment. Based on the rolling-over torque (depending on the weight of the load and the reach of telescopic arm 18), the contact means arranged in contact with the support surface (in this specific case, wheels 14 and driving wheel 34) generate a constraining reaction with respect to the support surface; as the rolling-over torque changes, the constraining reaction of wheels 14, 34 changes accordingly, so as to generate a stabilizing torque which Therefore, based on the constraining reactions of the different contact means, the mutual position between the first 36 and the second portion 38 of base frame 12 will change, since the first and the second portion are mutually constrained by means of a hinge 42 and an elastic means 40. As a consequence, when the rolling-over torque assumes a predetermined limit value, or a danger one, which corresponds to a mutual position between the first 36 and the second portion 38, the control system detects said mutual position and, if the mutual position reaches a threshold condition, or a limit or "danger" value, the control system carries out predetermined tasks of the crane.

Even if in the example shown the contact means arranged in contact with the surface include wheels 14, 34, it is also possible to use other known contact means, such as a track etc.

For example, with reference to the variant shown, when safety conditions are in place the first 36 and the second portion 38 are spaced apart in the area close to elastic means 40. As the rolling-over torque increases, said portions 36, 38 get closer by rotating, thus compressing elastic means 40, until striker portion 50 touches sensor 48; now the control system intervenes by carrying out predetermined tasks of crane 10, since the mutual position between portions 36, 38 has reached the threshold condition. According to a preferred variant, elastic means 40 works in compression. Alternatively, elastic means 40 works in traction.

By changing the geometry of crane 10 or of the base frame of crane 10, the stiffness of elastic means 40, or by setting sensor 48 or the control system differently, the user can freely define how the roll-over protection system should intervene.

Furthermore, as one can clearly understand, the roll-over protection system also intervenes in order to prevent crane 10 from rolling over in dynamic operating conditions, since crane 10, in order to move the loads, moves its parts and, if necessary, moves along the support surface.

Optionally, the control system is capable of detecting the mutual position between the first 36 and the second portion 38 as a variation of said mutual position relative to an initial position in which crane 10 is in a safety condition. If said variation of the mutual position exceeds a predetermined threshold value, the control system carries out predetermined tasks of the crane. For example, it is possible to detect a variation of the deformation of elastic means 40 relative to a predetermined initial deformation corresponding to a safety condition; if said variation of the deformation exceeds a predetermined threshold value, the control system carries out predetermined tasks of the crane.

With reference to the example shown, rudder 32 and driving wheel 34 belong to the first portion 36, while uprights 28, as well as the lifting mechanism, belong to the second portion 38.

Crane 10 preferably comprises at least one electric battery, which can be of the rechargeable type or not. Conveniently, the battery is rechargeable and can be recharged without being removed from the crane through suitable battery recharging means, for example by connecting the battery recharging means to an industrial or domestic socket outlet.

The battery is adapted to supply the power required to carry out one or more of the following operations: activating linear actuators 24, 26; activating the signaling devices, among which the acoustic and visual ones; supplying power to the control system; activating the ground drive transmission means (e.g. driving wheel 34); etc.

The roll-over protection system of the present invention can be integrated in many further types of crane, which are equipped, for example, with very different lifting mechanisms.

Figure 7:
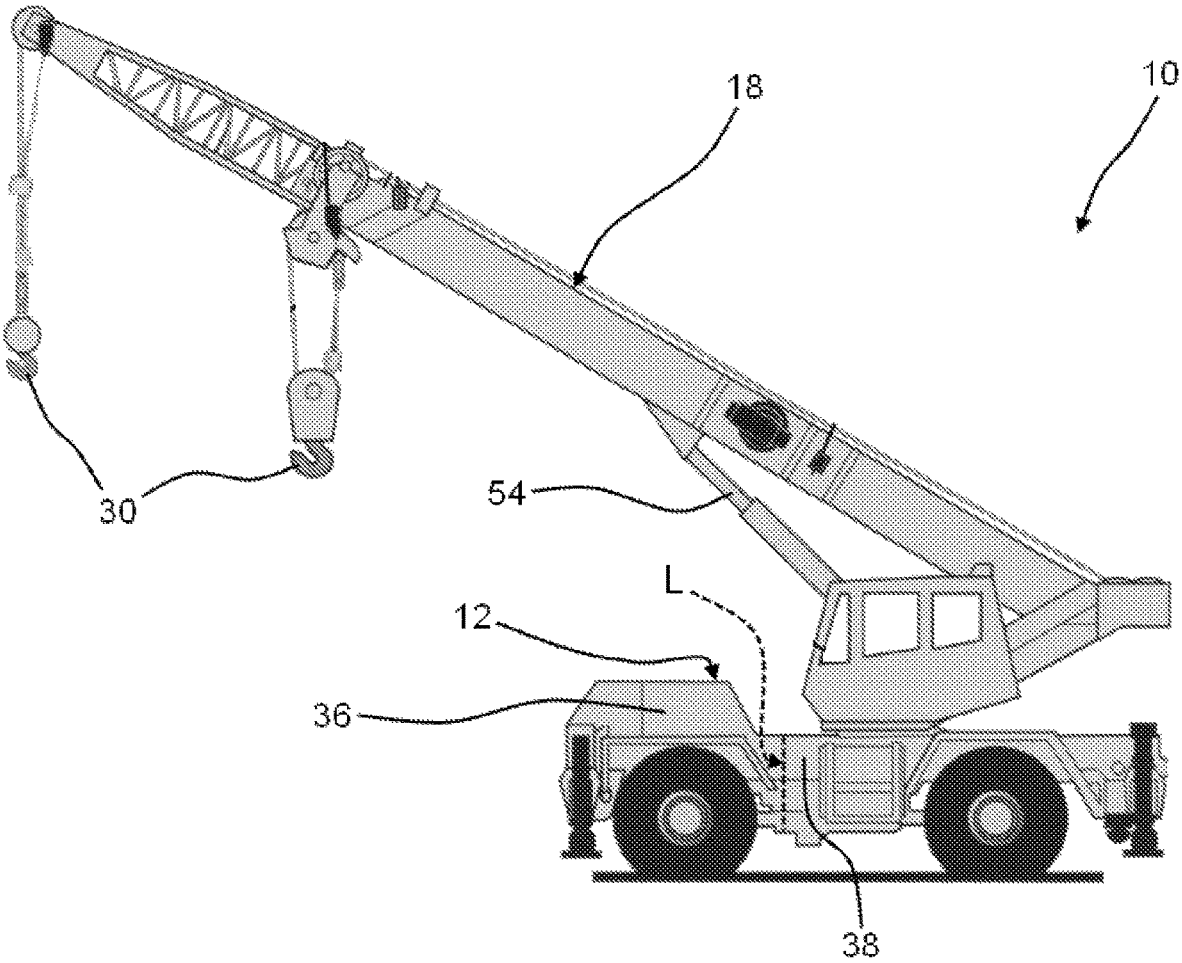
FIG. 7 is a lateral view of a crane according to a further embodiment of the present invention.

FIG. 7 shows a further variant of crane 10 having a simpler lifting mechanism and comprising: a telescopic arm 18 associated with base frame 12 (in particular with the second portion 38) and activated by a further linear actuator 54.

The figure does not indicate the roll-over protection system, however, this should be located (similarly to the embodiment described above) close to the broken line (indicated with letter L) separating the first 36 from the second portion 38 of base frame 12.

According to further variants, arm 18 of crane 10 can be moved by means of a wire rope system, alternatively or in addition to linear actuator 24, 26, 54.

Naturally, the principle of the present invention being set forth, embodiments and implementation details can be widely changed relative to what described above and shown in the drawings as a mere way of non-limiting example, without in this way going beyond the scope of protection provided by the accompanying claims.

KEY TO THE NUMERICAL REFERENCES crane 10
base frame 12
wheels 14
sliding element 16
arm 18
connection element 20
rod element 22
first linear actuator 24
second linear actuator 26
upright 28
hook 30
rudder 32
ground drive transmission means 34
first portion (of the base frame) 36
second portion (of the base frame) 38
elastic means 40
hinging point 42
support structure 44
steering linear actuator 46
sensor 48
striker portion 50
gear 52
further linear actuator 54

The invention claimed is:

1. A crane for lifting and transporting loads, comprising:

a base frame for transferring loads of the crane onto a support surface by wheels arranged in contact with said surface;

a lifting mechanism to lift and transport loads associated with said base frame;

a roll-over protection system comprising:

a first portion and a second portion of the base frame, mutually hinged to one another and rotating around a hinge, the first portion and the second portion being also constrained by at least one elastic element; and a control system for detecting a mutual position between the first portion and the second portion and of carrying out predetermined tasks of the crane when said mutual position reaches a threshold condition;

wherein the deformation of the at least one elastic element is linked to a mutual angular position of the first portion and the second portion;

wherein the first portion and the second portion of the base frame are constrained for rotating only around the hinge, wherein said rotating corresponds to a greater or smaller elongation of the elastic element.

2. The crane according to claim 1, comprising at least one sensor for detecting the mutual position between the first portion and the second portion; said at least one sensor being associated with the first portion and/or the second portion.

3. The crane according to claim 2, wherein said at least one sensor is a contact sensor or a proximity sensor.

4. The crane according to claim 1, wherein detection of the mutual position between the first portion and the second portion is carried out by detection of the deformation of the elastic element.

5. The crane according to claim 1, wherein the control system is configured so that, when the mutual position between the first portion and the second portion reaches a threshold condition, every movement of the crane that causes an increase in rolling-over torque is interrupted or inhibited.

6. The crane according to claim 1, wherein the control system is configured so that, when the mutual position between the first portion and the second portion reaches a threshold condition, one or more movements of the crane that cause a decrease in the rolling-over torque are carried out.

7. The crane according to claim 1, wherein, when the mutual position between the first portion and the second portion reaches a threshold condition, an emergency signal perceivable by a user is emitted.

8. The crane according to claim 1, comprising a telescopic arm; wherein when the mutual position reaches a threshold condition, the control system prevents the telescopic arm from extending or moving.

9. The crane according to claim 1, wherein the control system is adapted for detecting the mutual position between the first portion and the second portion as a variation of said mutual position relative to an initial position in which the crane is in a safety condition.

10. The crane according to claim 1, wherein said hinge is located in the lower part of the base frame and said elastic element is located in an upper part of the base frame.

11. The crane according to claim 1, wherein said elastic element is connected to the first portion and to the second portion of said base frame.

12. The crane according to claim 11, comprising a pair of elastic elements, each connected to the first portion and to the second portion of said base frame.

* * * * *